US005147040A

United States Patent [19]

Koike et al.

[11] Patent Number: 5,147,040

[45] Date of Patent: Sep. 15, 1992

[54] ROVING PACKAGE WRAPPER

[75] Inventors: Ryouzou Koike; Mituhiro Hashimoto, both of Fukushima, Japan

[73] Assignee: Nitto Boseki Co., Ltd., Fukushima, Japan

[21] Appl. No.: 592,919

[22] Filed: Oct. 4, 1990

[30] Foreign Application Priority Data

Oct. 6, 1989 [JP] Japan ..... 1-261484

[51] Int. Cl.[5] ..... B65D 85/67

[52] U.S. Cl. ..... 206/410; 206/460; 206/497

[58] Field of Search ..... 206/408, 389, 497, 392, 206/410, 460

[56] References Cited

U.S. PATENT DOCUMENTS

| | | | |
|---|---|---|---|
| 1,013,715 | 1/1912 | Yuste et al. | 206/53 |
| 3,410,394 | 11/1968 | Jackson et al. | 206/393 |
| 3,532,210 | 10/1970 | Minion et al. | 206/408 |
| 3,704,776 | 12/1972 | Collins | 206/389 |
| 3,731,792 | 5/1973 | Rolston | 206/389 |
| 3,734,273 | 5/1973 | Watanabe | 206/389 |
| 3,915,301 | 10/1975 | Gray et al. | 206/497 X |
| 3,929,226 | 12/1975 | Nijs | 206/408 X |
| 4,326,632 | 4/1982 | Koob | 206/389 |
| 4,348,439 | 9/1982 | Jones | 206/389 X |
| 4,460,086 | 7/1984 | Davis | 206/389 |
| 4,467,916 | 8/1984 | Hedden et al. | 206/497 X |
| 4,664,260 | 5/1987 | Stokes | 206/408 X |
| 4,763,785 | 8/1988 | Bradley et al. | 206/389 |

*Primary Examiner*—Paul T. Sewell
*Assistant Examiner*—Beth Anne Cicconi
*Attorney, Agent, or Firm*—Sixbey, Friedman, Leedom & Ferguson

[57] ABSTRACT

A roving package wrapper comprises a roving package formed by roving wound into a cylindrical configuration, and a collapse prevention member or material bonded to the outer surface of said package for maintaining or supporting the roving of the outermost layer thereto. Therefore, the collapse prevention material or member is adhered to the outer surface of the roving package, and has enough strength to adhesively hold the outermost roving when the outermost layer of roving only remains, thereby preventing the collapse of the roving.

13 Claims, 2 Drawing Sheets

ROVING PACKAGE WRAPPER

BACKGROUND OF THE INVENTION

The present invention relates to a roving package wrapper having a roving package formed by winding roving such as glass fiber.

Roving is used as a reinforced material for fiber reinforced plastic (hereinafter referred to as FRP). The roving is wound to form a hollow cylinder i.e., a package of roving. The hollow cylindrical package of roving is typically provided to the user.

Conventionally, a glass fiber roving package is made as follows. Glass strands are separately pulled from a plurality of cakes of glass fiber strands installed on a creel. Some tension is applied to each of strands and they are gathered into a bundle. The bundle passes through a guide and a tension gate and then through a traverse guide eye of the winder. The bundle is wound on a mandrel of the winder while transversely moving the guide eye. With winding the bundle onto the mandrel, some tension is applied thereto so as to wind the bundle tight. This prevents the roving package from collapsing and the roving from forming loops, when the roving being pulled from the inside of the package reaches the outermost layer of the package. If the collapsing of the roving package or the formation of the loops occurs, the undesired wastes occurs and the continuous production process cannot be attained.

The winder is equipped with the rotating mandrel and the guide eye reciprocated close to the surface of the package being formed on the mandrel. The mandrel is linked with a drive adjustment mechanism which control the rotation speed of the mandrel, so as to maintain the circumferential speed at a constant value even if the winding is advanced. Further, in order to wind the roving tightly, the package being formed on the mandrel is continuously pressed by a depressing roller. The package thus made is typically sized into a diameter of 240–280 mm, a height of 250–300 mm and a weight of 13–20 Kg.

In another conventional method for manufacturing roving package, known as a direct winding roving, a great number of glass fibers spun from a bushing are bundled up and wound directly. This method is used for manufacturing roving which requires a uniform tension applied to strands and which is indispensable for space development or producing FRP parts having high performance. By using a bushing provided with 1,000 hole or more, it is possible to produce a fiber of 10 microns diameter. The winder is an important of that used for producing normal glass fiber, and incorporates a special controller at the end of the traverse portion so that the roving package can be square at its end, or a square-end package can be formed. The rotation speed of the collet is programmed to thereby achieve a predetermined winding speed. With this manufacturing process, the dimensions and weight of manufactured package are the same as those given above.

The roving packages produced in this manner are wrapped in heat shrinkage film in order to avoid damage during transportation or handling. On transportation, plural packages stacked up vertically are lined up in parallel so as to form a rectangular parallelepiped as a whole. These are then covered in corrugated cardboard to avoid damage and the outer surfaces of these are bound tightly with heat shrinkage film.

When roving is used for manufacturing FRP by such methods as SMC, filament winding or spray up, roving 2 is pulled out from the inside of the roving package 1 as shown in FIG. 7, and then fed into cutter (not shown). Further, in order to continuously use packages, the winding end 2*a* of roving of the outermost layer of one package is pulled out of the central upper opening of the heat shrinkage film which wraps the package, and then the winding end 2*a* is, in advance, tied to the winding top 2*b* of roving of another roving package 1 to be subsequently pulled out.

However, the roving package as manufactured above suffers from problems in that, in the case where the roving is pulled from the inner side of the package and the thickness of roving, which remains therein, becomes smaller as the roving gets closer to the end of the roving package, with a light external force to pull out the roving, the roving which remains as outermost layer of the package collapses under its own weight, and loops and/or complicated knots are formed. As a result, these loops or knots are grasped in the guide of the supply equipment, thereby rendering it impossible to pull out the roving continuously.

This trouble results in undesired stoppage of production, and further, in the case where SMC sheets or the like is manufactured by simultaneously employing a plurality of roving, the amount of supplied roving is caused to be decreased, so that the products result in unevenness of glass contained therein.

In particular, since large-sized packages have their greater outer diameters and heights, the roving, which remains therein, collapses frequently during the pulling out process. A solution of the above problems has been therefore expected to be found urgently.

SUMMARY OF THE PRESENT INVENTION

The present invention was conceived in view of the above problems, and aims to provide a roving package wrapper which would allow the roving to be pulled out well up to the outermost layer without collapse of the roving during pulling out the roving of the outermost layer.

As a result of the present inventors' earnest examination to solve the above-mentioned problems, it was found that the collapse of the outermost layer could be prevented by applying a material which would provide a self-supporting structure in the form of a film, a sheet, or the like, adhering to the outer surface of the package, to thereby achieve the objective of the present invention.

In other words, the present invention is a roving package wrapper, comprising a roving package formed by roving wound into a cylindrical configuration, and a collapse prevention member or material bonded to the outer surface of said package for maintaining or supporting the roving of the outermost layer thereto.

Roving used for the present invention is usually a glass fiber, and besides a carbon fiber or the like may be used if needed. Preferably, roving is comprised of individual fibers of the order of 1,000 through 20,000. The roving package can be formed by known methods. That is, the strands drawn from cakes may be put together and wound up, or spun fibers may be bundled up and directly wound up. Although there is no fixed weight for the roving package applied to the present invention, the present invention is particularly effective when applied to such large-sized packages as those from 50 to 300 Kg.

According to the present invention, the collapse prevention material or member is adhered to the outer surface of the roving package, and has enough strength to adhesively hold the outermost roving when the outermost layer of roving only remains, thereby preventing the collapse of the roving. More specifically, a sheet material, with which the outer surface of roving package is wrapped, heat shrinking film for wrapping the package, or the like can be employed as the collapse prevention member (described later in detail). As for the adhesion strength between the collapse prevention material and the roving, adhesion of the roving to the collapse prevention material should be maintained when the roving is not being pulled out, but it is preferable that, when the roving is being pulled out, it can be torn away from the collapse prevention material. Regardless of this, however, the adhesion strength may be larger. As roving is composite material made up of a great many thin fibers, only a part of the fibers on the surface of the roving adheres to the collapse prevention material. Thus, when the roving is pulled out, in the case where the adhesion strength is great, fibers may remains bonded to the collapse prevention material, however, the greater part of the fibers will tear off and it is possible to pull the roving out with ease.

In the roving package wrapper constructed according to the present invention, since the roving of the outermost layer of the package is bonded to the collapse prevention material, when only the outermost layer of the roving remains through pulling out from the inside surface of the roving package, the outermost layer is maintained by or supported to the collapse prevention material. Thus, the outermost layer is prevented from collapsing and falling down. Further, since the roving of the outermost layer is bonded to the collapse prevention material in such a manner that the roving is torn away form the collapse prevention member, the bonded roving can be gradually pulled out from the package without hindrance. Accordingly, the roving can be pulled out well up to the end without the formation of tangles or the like.

DETAILED DESCRIPTION OF THE PREFERRED EMBODIMENTS

Preferred embodiments of the present invention will now be described in detail with reference to the accompanying drawings.

Figure 1:
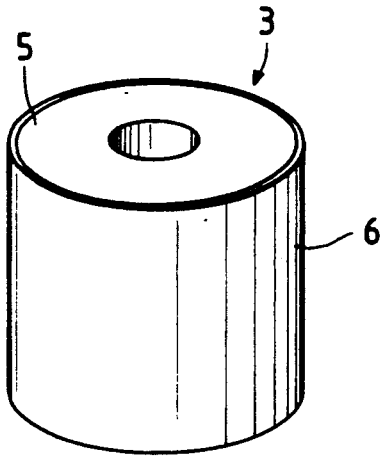
FIG. 1 is a schematic perspective view showing a roving package wrapper according to an embodiment of the present invention.
Figure 2:
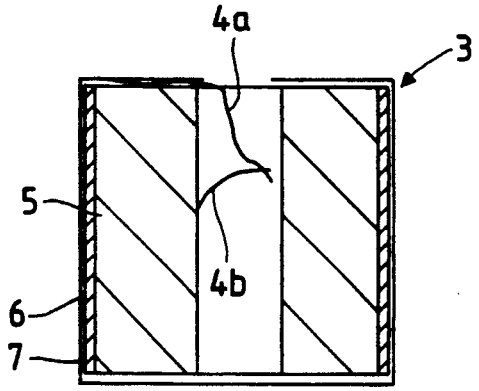
FIG. 2 is a schematic cross-sectional view showing the roving package wrapper shown in FIG. 1.

FIGS. 1 and 2 illustrate a roving package wrapper according to an embodiment of the present invention. The roving package wrapper 3 comprises a package 5 formed by the roving wound into a cylindrical configuration, a sheet 6 bonded onto an outer circumferential surface of the package 5, and a heat shrinking film 7 (omitted in FIG. 1) for wrapping the entire body. The roving which forms the package 5, has a terminal end 4*a* and a starting end 4*b* connected with one another. Therefore, both ends can be easily pulled out from the package 5.

Figure 3:
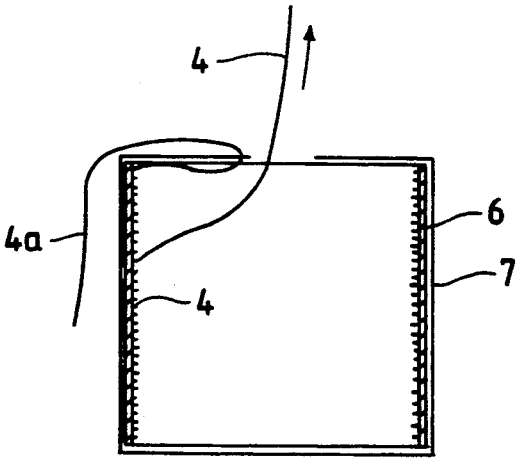
FIG. 3 is a schematic cross-sectional view showing the roving package wrapper in a state that the end of the winding is pulled out from the package.

As shown in FIG. 3, the sheet 6, which constitutes the collapse prevention member, has such degree of strength that it is capable of supporting or standing itself after the roving 4 has been almost entirely pulled out. Normally, a resin sheet in the form of a uniform or one layer is used as the collapse prevention member i.e., the sheet 6, however, other materials such as multiple layer resin bodies or paper may also be used. As for the thickness of the sheet 6, where a resin sheet is used, taking into the consideration such factors as surface strength and cost, 20–300 microns is preferable. It is also acceptable for the sheet 6 to be bonded to the heat shrinking film 7. In this case, the heat shrinking film 7 reinforces the sheet 6, so that the strength of the sheet 6 may be lower. The sheet 6 shown in the drawings may be constructed in such a manner that a flat-like sheet is wound round the outer circumference of the package 5. On the other hand, it is applicable for the sheet 6 to set around the package 5 a cylindrical sheet wound in advance.

As for the method of bonding the sheet 6 to the outer surface of the package 5, a method employing adhesion agents or bonding agent as well as a heat bonding method using a heat bondable material as a sheet 6, or other method are applicable. In terms of adhesion materials, crude rubber or rubber type adhesion agents, such as SBR, may be used. In terms of bonding agents, pressure sensitive adhesive may be used such as, for example, crude rubber, SBR, polyisobutylene, metamorphic acrylic resin. Further, instead of bonding the sheet 6 to the outer surface of the package 5 with a bonding agent, both bodies i.e., the sheet 6 and the package 6 may be bonded with a pressure sensitive adhesive double coated tape. It is also possible to interpose a heat bondable resin film between the sheet 6 and the package 5. In this case, when the heat shrinking film is heated and shrunk, the resin film softens and, with heat shrinking force of the heat shrinking film, the sheet 6 is tightly bonded onto the package 5 together with the resin film to thereby achieve the bonding.

In the case where the sheet 6 is heat bonded to the package 5, the present invention does not limit the heat bonding manner and the material of the sheet 6 for the sheet bonding manner. However, it is preferable to enact this heat bonding at the same time at which the heat shrinking film is heat shrunk (described later in detail). For this reason, it is preferable to use a heat bonding substance which activates at the temperature at which the heat shrinking film shrinks. As concerns this material, where the heat shrinking film is a polyvinylchloride group, it is possible to use heat plasticity resins, such as polyethylene, etylenevinylacetate co-polymer resin and vinyl acetate resin, or to use a material having a heat plasticity resin on its surface.

As for the position bonding the sheet 6 to the package 5, the entire outer circumferential surface of the package may be used. However, it is not necessary to use the entire outer circumference of the package so as to bond the sheet onto the package if the outer layer of the roving is prevented from collapsing. For example, the sheet may be bonded onto a plurality of longitudinally extending belt-like portions provided on the outer circumferential surface of the package if the outer layer roving is maintained by or supported to the sheet.

It is possible to apply various methods to the bonding of the sheet 6 onto the outer circumference of the package 5. However, it is preferable to simultaneously perform the heat bonding of the sheet 6 onto the outer circumference at the time when the package wrapping 3 is put into a heat set oven in order to cause the shrinking of the heat shrinking film 7. This is because processing is made easy or simple.

In this case, in terms of the materials for the sheet 6 and the heat shrinking film 7, one should be select a sheet material of the sheet 6, which activates at the temperature at which heat shrinking of the heat shrinking sheet 7 occurs. For this, the sheet 6 should be wrapped around the outer circumference of the package 5 and temporarily fixed by some suitable means (for example, temporarily fixing both end of the sheet 6 where they meet, with adhesive tape). After that, the package 5 with the sheet 6 is wrapped with the heat shrinking film 7 in advance of heat shrinking, and then, the entire body is placed in a heat set oven and heated. This done, at the temperature at which the heat shrinking film 7 is heat shrunk, the surface of the sheet 6 softens, and further, the force of contraction of the heat shrinking film 7 pushes the softened sheet 6 onto the package 5, and the sheet 6 is adhered to the package 5. Thus, the heat shrinking and the heat adhesion can be performed at one time with easy operation.

There is no particular restriction on the material for the heat shrinking film 7, so long as it is suitably strong enough to protect the roving.

The above mentioned roving package wrapping 3 is also used in the same manner as it was previously. The roving 4 is consumed by pulling it out from the inside surface of the package 5. As a result, due to almost consuming the roving 4, only the outside layer of the roving remains as shown in FIG. 3. However, This roving 4 is bonded to and supported to the sheet 6 by its adhesive force, so that the roving neither collapses nor falls down. When this remaining roving 4 is pulled out, the force of the pulling successively or gradually tears the roving away from the sheet 6, and it is used. Should the sheet cause trouble by rising up or moving around under the force of the roving 4 being pulled away from the sheet 6, is may be fixed by some suitable means to the floor or the like. Thus, the roving can be pulled out to the last layer of package 5 without the occurrence of such trouble as collapsing and falling down, and the problems which occur during its use, such as work stoppages, can be avoided. Further, with this roving package wrapper 3, where the end of the roving has been connected to the beginning of the roving of the next roving package, the roving can be pulled out continuously. In this case, where the roving from the first package has been used up, the remaining sheet 6 and the heat shrinking film 7 may be removed.

Figure 4:
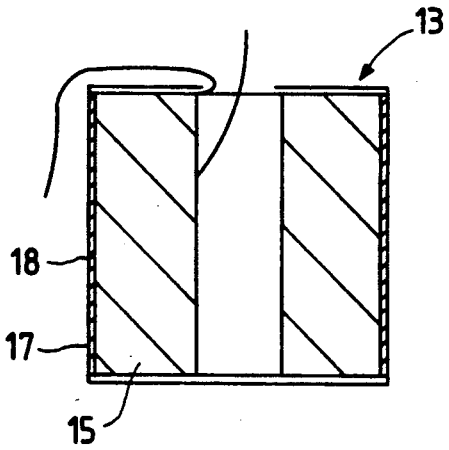
FIG. 4 is a schematic cross-sectional view showing a roving package wrapper according to another embodiment of the present invention.

FIG. 4 is a cross-sectional view showing a roving package wrapper according to another embodiment of the present invention. In this embodiment, the wrapper 13 involves the roving which is wound into a cylindrical package 15, the heat shrinking film 17 which is wrapped around the package 15, and the adhesion layer 18 which is bonded to the outer surface of the package 15 by heat shrinking film 17. The heat shrinking film 17 and the adhesion layer 18 give structure to the collapse prevention material. Hence, the heat shrinking film 17 which is used can be ordinary resin film which is usable for shrinking warping. However, the thickness of the heat shrinking film 17 should be fixed such that it possesses a degree of strength sufficiently great for it to be able to support itself. In practice, the thickness of the heat shrinking film 17 is preferably 20–300 microns.

Figure 8:
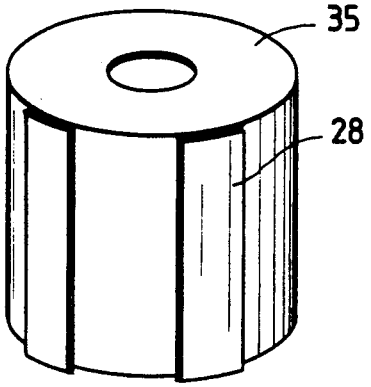
FIG. 8 is a schematic perspective view showing a roving package wrapper according to still another embodiment of the present invention in which bonding means are partially provided on the outer circumference of the roving package.
Figure 9:
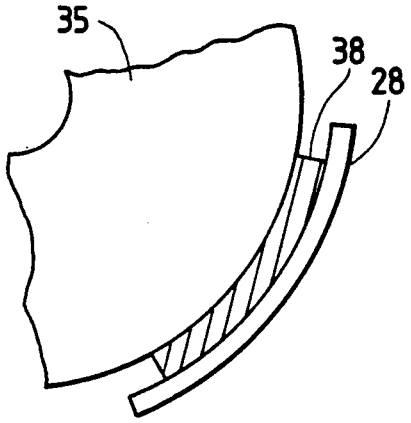
FIG. 9 is a schematic cross-sectional view showing a state in which a hot melt adhesion film is temporarily bonded onto the outer circumference of a roving package.

The adhesion layer 18 which bonds the heat shrinking film 17 to the package 15 can be ordinary rubber bonding agent, and adhesive agent or pressure sensitive adhesive double coated tape. However, in terms of handling, a material whose adhesion properties are realized during the heat shrinking of the heat shrinking film is preferred. As for the material for this, a material having a melting point lower than that of the heat shrinking film can be used. For example, a hot melt adhesion material being in the form of non-woven fabric, a hot melt adhesion material blown onto the surface of the package 15 and a resin film such as polyethylene, polypropylene, polyamide, vinyl chloride, ethylene vinylacetate polymer, vinyl acetate or the like, having heat plasticity (a thickness of 20–300 microns is preferred in terms of adhesion properties and handling properties), each of which has a melting point lower than that of the heat shrinking film, can be used. It is not absolutely necessary to prepare the entire surface of package 15 with the adhesion layer 18 which is to bond the heat shrinking film 17 to the package 15. Partial preparation to the extent the roving will not collapse is acceptable. For example, as shown in FIG. 8, a plurality of belt-like adhesion layers or bonding means 28 i.e., hot melt adhesion films, double coated tapes or the like, are provided on the outer circumference of the roving package 35 to extend in the axially lengthwise direction thereon. After that, the package 35 with the layers 28 are wrapped in the hot shrinking film, and then the wrapped package 35 is put into a heat set oven to be subjected to the hot shrinking process, thereby bonding the hot shrinking film onto the roving package 35 with layers 28. In the provision of the plurality of bonding means 28 on the package 35, it is preferable that hot melt adhesion materials or films are used as the bonding means and the bonding means are temporarily bonded on the outer circumference of the package 35 with temporarily bonding means 38 such as adhesion agents, bonding agents, double coated tapes or the like, as shown in FIG. 9. Due to this construction, the package 35 is easily wrapped in the hot shrinking film since the hot melt adhesion films do not have the bonding force in wrapping process which is in advance of heating process. Further, since each of the hot melt adhesion films is temporarily bonded onto the outer circumference of the package 35 in place with the temporarily bonding means 38, each of the hot melt adhesion films is prevented from slipping out of place, to thereby bond the heat shrinking film onto the outer circumference of the package at desired portions.

The package wrapping 13 shown in FIG. 4 is used in the same manner as package wrapper 3 shown in FIGS. 1 to 3 and the outermost layer of the roving is maintained by the self-supporting heat shrinking film 17, and prevention of the roving collapse is achieved.

Figure 5:
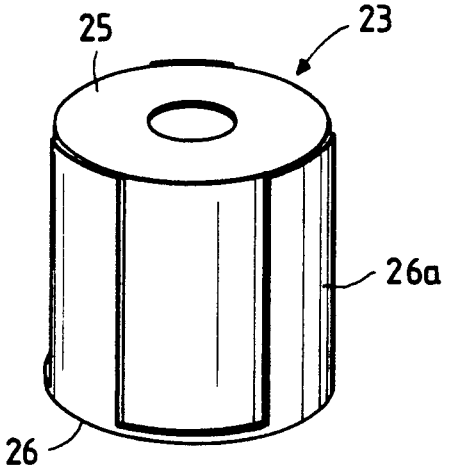
FIG. 5 is a schematic cross-sectional view showing a roving package wrapper according to yet another embodiment of the present invention.
Figure 6:
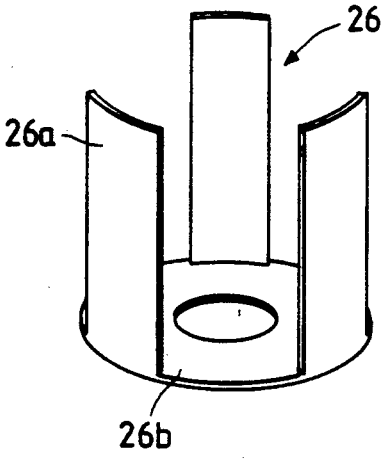
FIG. 6 is a schematic perspective view showing a collapse prevention member used for the roving package wrapper shown in FIG. 5.
Figure 7:
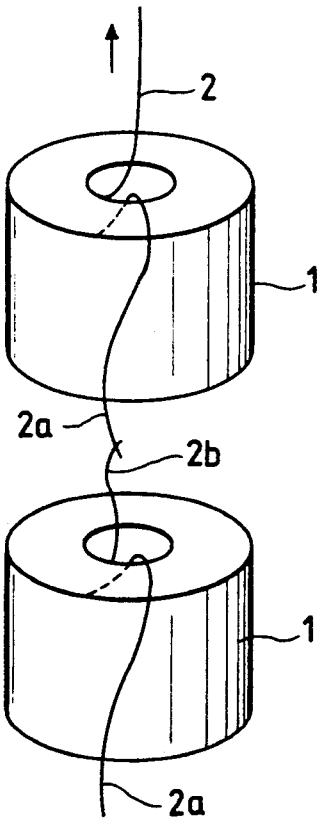
FIG. 7 is a schematic perspective view showing a state in which a roving is pulled out from a roving package with its end being connected with a top of a roving of another roving package.

The schematic perspective view in FIG. 5 shows a roving package wrapper 23 according to yet another embodiment of the present invention. The schematic perspective view in FIG. 6 shows a collapse prevention member 26 used in the roving package wrapper shown in FIG. 5. The roving package wrapper 23 of this embodiment is constructed in such a manner that a plurality of vertical portions 26*a* of the collapse prevention member 26 is bonded to a roving package 25. The entire body is wrapped in a heat shrinking film (not shown in FIGS. 5 and 6). The collapse prevention member 26 comprises a disk part 26*b* on which the bottom of the package rests, and the vertical portions 26*a* each of which arises at right angle from the disk part 26*b*. The collapse prevention member is normally made of resin. The adhesion of the vertical portions 26*a* to the outer surface of the package 25 can be performed in the same manner as stated in the embodiments above. In this embodiment, also, the roving of the outermost layer is bonded to and supported to the vertical portions 26*a* of the collapse prevention member 26, so that the collapse is prevented and all of the roving can be properly used.

Hereinafter, the embodiments of the present invention will be described.

EMBODIMENT 1

On the surface of a roving package having an exterior diameter of 550 mm, a height of 600 mm and a weight of 200 kg, a polyethylene resin sheet having a thickness of 200 microns and a melting point of 115° C. was wrapped. It was held in place with cellophane tape. Over that, a vinylchloride resin heat shrinking bag, having a thickness of 40 microns and a melting point of 170° C. was placed. This was heat processed in a heat set oven which circulated hot air at 130° C. In this manner the roving package wrapper shown in FIG. 2 was achieved. Four of these roving packages were placed level on a plate and the ends of the roving of each of the packages were connected to the beginnings of the rovings of the corresponding packages. These packages were used and where using the spray up method, a continuous mold examination was performed, the outermost layer of the roving maintained adhesion to the polyethylene resin sheet surface. There was no collapsing or falling down and all four packages were used in a continuous fashion without any trouble until the end of the roving had been used.

EMBODIMENT 2

A composite rubber type adhesive product (Spray Glue 55, produced by Sumitomo 3M Co., Ltd.) was applied to the inner surface of a 40 micron polyvinylchloride heat shrinking film and this was wrapped around the same type of roving package used in the Embodiment 1. This was then heat processed in a heat set oven which circulated hot air at 130° C. In this manner the roving package wrapper shown in FIG. 4 was achieved. This was used in the same manner as in the embodiment 1 and, in the same manner as in the Embodiment 1, no problems at all occurred.

EMBODIMENT 3

On the same type of roving package used in Embodiment 1, 18 mm wide pressure sensitive adhesive double coated tape (Scotch N-665-3-18, produced by Sumitomo 3M Co., Ltd.) was stretched onto the package, following the cylindrical surface, every 120° C. in three places. The entire body was wrapped in 40 micron polyvinylchloride heat shrinking film and heat processed in a heat set oven which circulated hot air at 130° C. In this manner the roving package wrapper shown in FIG. 4 was arrived at. This was used in the same manner as in the Embodiment 1 and, in the same manner as in the Embodiment 1, no problems at all occurred.

EMBODIMENT 4

The same type of roving package as was used in the Embodiment 1 was wrapped in 25 micron ethylene vinylacetate polymer resin film and this was wrapped in 40 micron polyvinylchloride heat shrinking film and heat processed in a heat set oven which circulated hot air at 130° C. In this manner a roving package wrapper where the outer surface of the package was bonded to the polyvinylchloride heat shrinking film by means of the ethylene vinylacetate polymer resin films was achieved. This was used in the same manner as in the Embodiment 1 and, in the same manner as in the Embodiment 1, no problem at all occurred. Further, the outermost layer of polyvinylchloride heat shrinking film and ethylene vinylacetate polymer resin film bonded and, as they could be used like a single sheet, even with a thin film, it had a high enough degree of strength to support the outermost surface of the roving. When the outermost surface of the roving was pulled out, no stoppages in the supply occurred due to the collapse of the film.

COMPARATIVE EMBODIMENT 1

Without using the heat plasticity resin sheet which was placed between the roving package surface and the heat shrinking film, in the same manner as an ordinary roving package, polyvinylchloride heat shrinking film was used and a roving package wrapper was made. This was used under same conditions as in Embodiment 1 where using the spray up method a continuous mold examination was performed, when the roving from the outermost surface of the package was used, tangles occurred in the roving and the roving guide become blocked and manufacturing could not be continued.

In the manner, as the roving package wrapper of the present invention maintains adhesion between outermost layer of roving of the package and the collapse prevention member, when pulling the roving from the inner surface of the package, even when only the outermost layer of the roving remains, collapse prevention is maintained for that outermost layer, thus, without collapses or such things as tangles in the roving, the roving can be pulled out well to the very end. Further, resulting roving packages can be used several at a time so that continuous usage become possible.

What is claimed in:

1. A roving package and wrapper comprising:

a roving package including roving wound into a substantially cylindrical configuration with an outer circumferential surface;

a heat-shrinking film wrapped about said outer circumferential surface of said roving package; and a heat-bondable resin sheet interposed between said heat-shrinking film and the outer circumferential surface of said roving package to bond said sheet and said heat-shrinking film to said outer circumferential surface, said heat-bondable resin sheet having adhesive properties which are realized at temperatures associated with heat-shrinking of the heat-shrinking film such that the heat-shrinking film and the sheet are bonded to the roving package outer circumferential surface as the heat-shrinking film is heat-shrunk onto the roving package.

2. The roving package and wrapper of claim 1, wherein the heat-bondable resin sheet comprises at least one of polyethylene and a copolymer of ethylene and vinylacetate.

3. The roving package and wrapper of claim 1, wherein the heat-bondable resin sheet is provided at a plurality of locations spaced about the outer circumference of the roving package.

4. The roving package of claim 1, wherein the heat-bondable resin sheet has a melting point lower than the melting point of the heat-shrinking film.

5. A roving package and wrapper comprising:

a roving package including roving wound into a substantially cylindrical configuration having an outer circumferential surface;

heat-bondable polymer resin films provided at a plurality of locations adjacent said outer circumferential surface of the roving package; and a heat-shrinking film wrapped about the outer circumferential surface of said roving package and said heat-bondable polymer resin films, wherein said heat-shrinking film has a melting point higher than the melting point of the heat-bondable polymer resin films and is bonded to said outer circumferential surface by said polymer resin films.

6. The roving package and wrapper of claim 5, further including a sheet interposed between said heat-shrinking film and said heat-bondable polymer resin films.

7. The roving package and wrapper of claim 5, wherein said heat-bondable polymer resin films are formed from a polymer selected form the group consisting of polyethylene and a copolymer of ethylene and vinylacetate.

8. A method for preparing a roving package comprising:

providing a roving package having roving wound into a substantially cylindrical configuration to form an outer circumferential surface;

providing a heat-shrinking film about said roving package outer circumference;

providing a heat-bondable resin film interposed between said heat-shrinkable film and said outer circumferential surface, said heat-bondable resin film being activated at temperatures associated with heat shrinking of said heat-shrinkable film;

applying heat to shrink said heat-shrinkable material and to substantially simultaneously activate said heat-bondable resin film, thereby bonding said film and said heat-shrinkable material to said outer circumferential surface.

9. The method of claim 8, wherein the step of providing a heat-bondable resin film includes providing a heat-bondable resin film at a plurality of locations adjacent said outer circumferential surface of said roving package.

10. The method of claim 8, wherein said heat-bondable resin film comprises at least one of polyethylene and a copolymer of ethylene and vinylacetate.

11. The roving package of claim 2, wherein said heat bondable resin sheet is associated with a material and wherein the material is interposed between the heat-shrinking film and the roving package outer circumferential surface to thereby interpose the heat-bondable resin between the outer circumferential surface and the heat-shrinking film.

12. The roving package of claim 7, wherein said heat-bondable polymer resin film is associated with a material and wherein the material is interposed between the heat-shrinking film and the roving package to thereby interpose the heat-bondable polymer resin film between the roving package and the heat-shrinking film.

13. The method of claim 10, wherein the step of providing a heat-bondable resin film includes interposing a material having the heat-bondable resin film associated therewith between the roving package and the heat-shrinkable film.

* * * * *